United States Patent [19]

Hemsath

[11] 4,321,961

[45] Mar. 30, 1982

[54] THERMAL ENERGY EXCHANGING DEVICE

[75] Inventor: Klaus H. Hemsath, Toledo, Ohio

[73] Assignee: Midland-Ross Corporation, Cleveland, Ohio

[21] Appl. No.: 205,840

[22] Filed: Nov. 10, 1980

[51] Int. Cl.[3] ..... F28D 19/04

[52] U.S. Cl. ..... 165/8; 165/10; 55/390; 422/178; 422/223

[58] Field of Search ..... 165/8, 9, 7, 10, 4, 165/6; 55/390; 422/178, 223

[56] References Cited

U.S. PATENT DOCUMENTS

| | | | |
|---|---|---|---|
| 2,294,214 | 8/1942 | Seinfeld | 165/9 X |
| 2,334,555 | 11/1943 | Howard | 422/223 X |
| 2,355,024 | 8/1944 | Yerrick et al. | 422/223 X |
| 2,540,733 | 2/1951 | Holm | 165/7 |
| 2,706,109 | 4/1955 | Odman | 165/10 X |

FOREIGN PATENT DOCUMENTS

| | | | |
|---|---|---|---|
| 1035176 | 7/1958 | Fed. Rep. of Germany | 165/9 |
| 1050077 | 12/1966 | United Kingdom | 165/8 |

*Primary Examiner*—Albert W. Davis
*Attorney, Agent, or Firm*—Harlan E. Hummer

[57] ABSTRACT

A thermal energy exchanging device is described as having a stationary, hollow cylindrical gas distributing member around which a closed, hollow torus-shaped member rotates. The stationary member is longitudinally and transversely divided into four compartments. The hollow enclosure of the rotatable member is longitudinally divided into a plurality of pie-shaped sections which contain thermal energy responsive material. Sealing means are provided between the two members to divide the annular space therebetween into four segments which are radially aligned and communicate with the four compartments of the stationary member. The sealing means, in effect, divides the device into two sides or two separated chambers through which gases of different temperatures are simultaneously circulated into thermal energy exchanging relation with the heat responsive material that happens to be in that particular chamber at the moment.

18 Claims, 3 Drawing Figures

THERMAL ENERGY EXCHANGING DEVICE

BACKGROUND OF THE INVENTION

The invention broadly relates to a device that is useful in, for example, heat or mass transfer, the separation of gases by absorption or desorption, the concentration of fluids, catalytic reactions, or particle cleaning. Such a device is especially suitable for use as a heat wheel or rotary recuperator in which, for example, heat energy from hot exhaust flue gas is captured and used to preheat combustion air or hot gas used in a particular process from which the hot exhaust gas is being removed.

Rotary recuperators or heat wheels are well known and used in the exchange of thermal energy between hot and cool gases. Generally, such devices employ stationary hot and cold gas chambers through which a rigid, preformed, torus-shaped heat wheel is rotated to be alternately heated and cooled by the gases being circulated through the device. The heat wheel is composed of thermal energy responsive material, e.g. honeycombed ceramic-type material, through which the hot and cool gases are circulated to achieve a thermal energy exchange between the gases and material.

A serious problem of such devices is in the provision of a good effective seal between the stationary hot and cold gas chambers and the rotary heat wheel which, because of a pattern of alternating heating and cooling, has portions that are constantly expanding and contracting in such a way as to cause continual warping and distortion of the heat wheel thereby making it exceedingly difficult for the seal to maintain contact with the rotary wheel. Thus, it is not uncommon for such devices to experience gas leakage between the two stationary chambers, which leakage generally disrupts the heat exchanging process when the seals become the least bit worn and ineffective. The invention is primarily designed to overcome this problem by the provision of a heat exchanging device in which it is not necessary to maintain a seal in contact with the thermal energy responsive material.

Briefly stated, the invention is in a device which comprises a stationary, hollow, cylindrical fluid distributing member and a hollow closed torus-shaped rotary member which is mounted for rotation about the stationary member in a plane which is generally normal to the longitudinal axis of the stationary member. The stationary member is longitudinally and transversely divided into four compartments, through which fluid is circulated between pairs of longitudinally communicating compartments. The rotary member is divided into pie-shaped sections or chambers which carry material through which fluid can be circulated. A plurality of longitudinally extending wiper-type seals and circumferentially oriented ring seals are positioned in the space between the rotary and stationary members and divide the space into four segments which are in communication with the four compartments of the stationary member. The seals literally divide the device into two chambers through which different fluids can be simultaneously circulated free of each other. The compartments of the stationary member and the sections of the rotary member are provided with communicating openings so that one fluid can be circulated through a first pair of compartments and communicating sections while another fluid is circulated through the second pair of compartments and communicating sections.

It can be appreciated that it is much simpler to provide good effective seals between the inner periphery of the rotating closed torus and the adjacent outer periphery of the stationary cylinder, than it is to provide good, continuous contact of a flap seal with a twisting heat wheel of the prior art. In addition, the device of the invention has the added advantage of not being restricted in the shape or size of, for example, the thermal energy responsive material that is carried by the rotary member. Most heat wheels are preformed of thermal responsive material into a comparatively rigid ring, but this is understandable, since it is the rotating member. The rotary member of this invention carries and supports the thermal energy responsive material which can be composed of any suitable loosely or tightly packed particulate material as well as having the more rigid structure previously described.

DESCRIPTION OF THE DRAWING

The following description of the invention will be in relation to a thermal energy exchanging device by way of example and will be better understood by having reference to the accompanying drawing, wherein.

DESCRIPTION OF THE INVENTION

Figure 1:
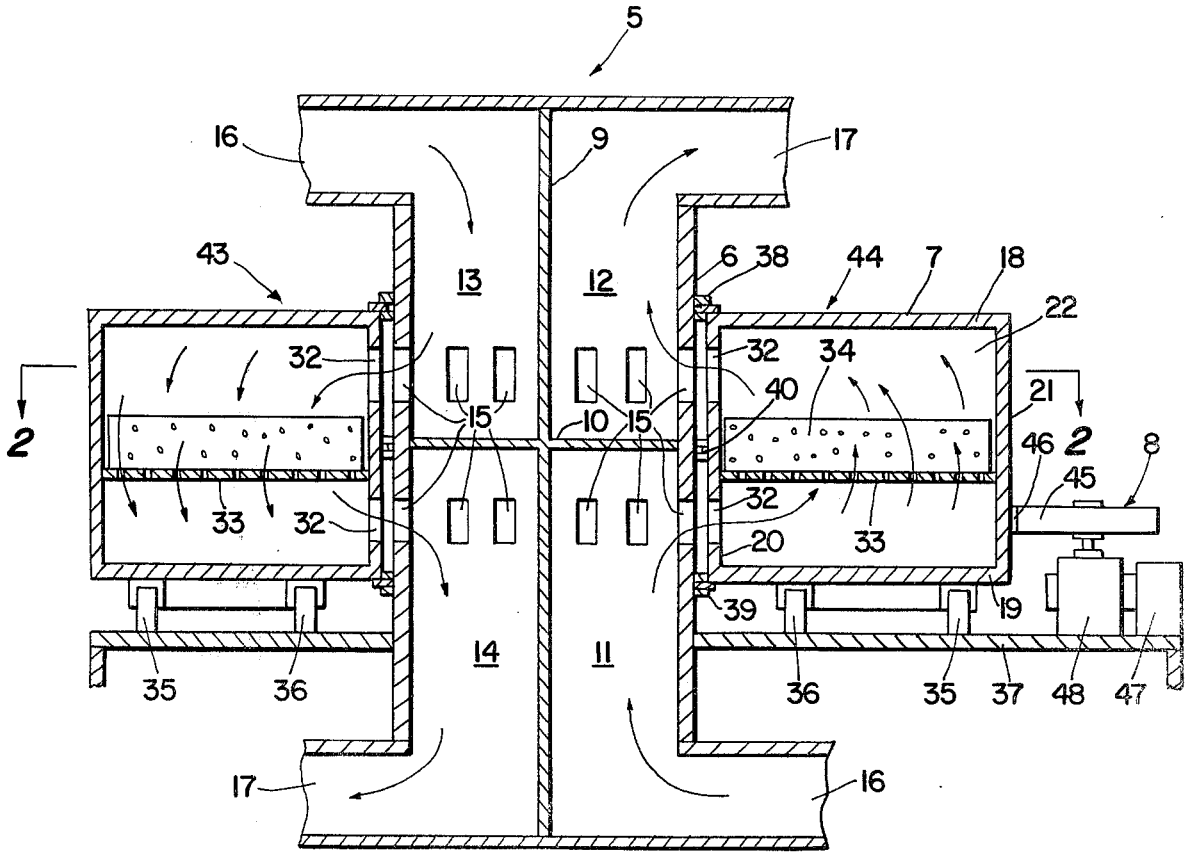
FIG. 1 is a cross-section of a thermal energy exchanging device which is made in accordance with the invention.
Figure 2:
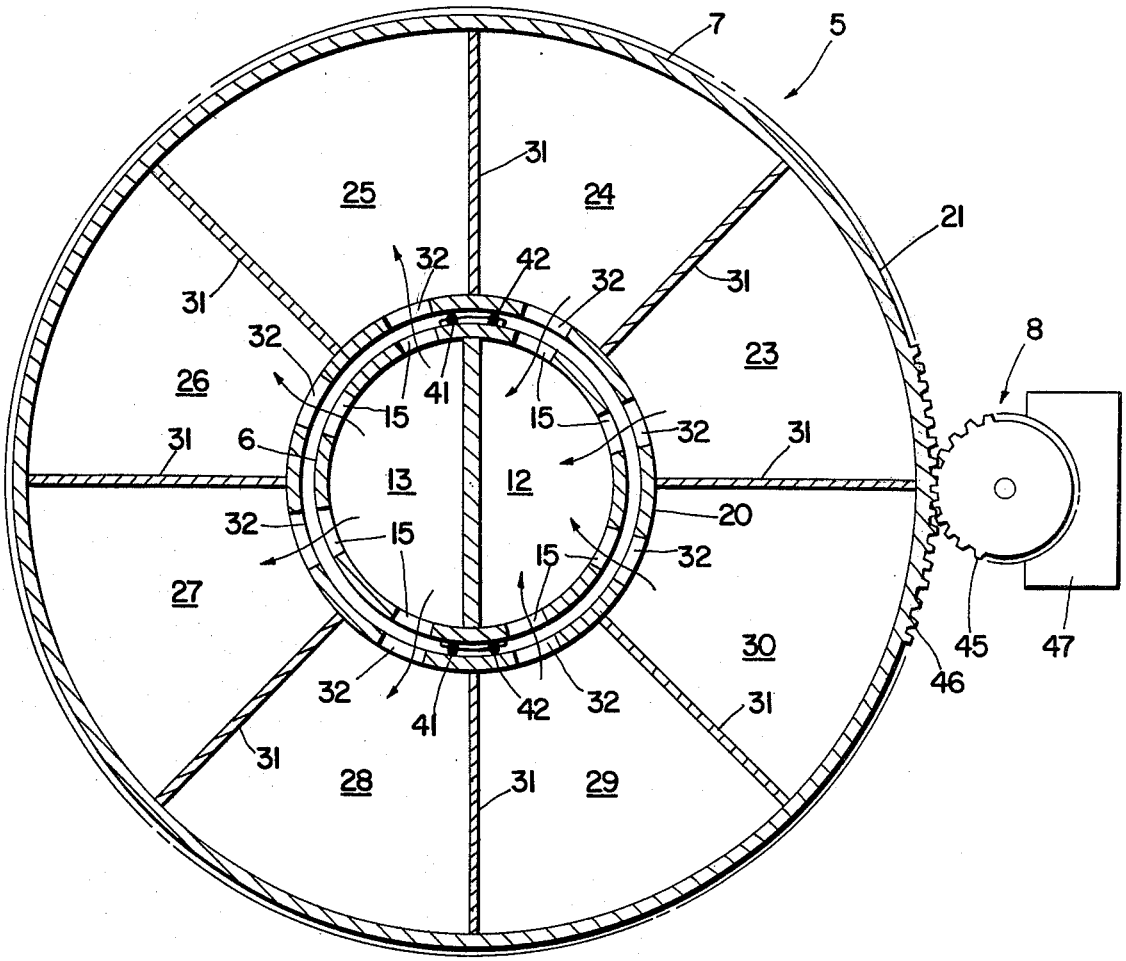
FIG. 2 is a section of the device viewed from the line 2—2 of FIG. 1.

With general reference to the drawing for like parts and more particular reference to FIGS. 1 and 2, there is shown a thermal energy exchanging device 5 which essentially comprises: a stationary, thermally insulated hollow cylindrical gas distributing member 6; a hollow, doughnut or closed torus-shaped thermally insulated member 7 that is mounted for rotation about the stationary member 6 in a plane which is substantially normal to the longitudinal axis of the stationary member 6; and any suitable drive mechanism 8 for rotating the rotary member 7 about the stationary member 6.

The stationary member 6 is longitudinally and transversely divided by any suitable dividers 9,10 into four separated compartments. The first pair of longitudinally aligned compartments 11,12, relative to the longitudinal axis of the stationary member 6, is provided as a conduit or passageway through which, for example, hot exhaust gas, e.g. air, is circulated, such compartments hereinafter referred to as the hot air compartments 11,12. The remaining second pair of longitudinally aligned compartments 13,14 is provided as a conduit through which, for example, cool combustion air is circulated for preheating, such compartments hereinafter referred to as the cold air compartments. The four compartments 11–14 are each provided with a plurality of similar openings 15 adjacent the transverse divider 10. The openings 15 are generally equally arcuately spaced in the outer peripheral wall of the stationary member or compartments adjacent the rotary member 7. The hot air compartments 11,12 and the cold air compartments 13,14 are each provided with similar inlet and outlet ports 16,17. Although the arrows show that air is circulated in opposite directions through the hot and cold air compartments 11,12, and 13,14 it should be realized that the air circulation can be in the same direction, depending on the desired circulation and location of the inlet and outlet ports 16,17 of the device 5.

The rotary member 7 comprises a pair of opposing, parallel annular top and bottom endwalls 18,19 which are connected by a pair of inner and outer peripheral cylindrical walls 20,21 to define an enclosure 22 which, as best seen in FIG. 2 is divided into a plurality of generally pie-shaped chambers or sections 23–30 by similar, radially oriented dividers 31. The sections 23–30 are each provided in the inner cylindrical wall 20 with openings 32 that correspond to the openings 15 in the four compartments 11–13 of the stationary member 6.

The sections 23–30 of the rotary member 7 are provided with any suitable means, such as a perforated plate 33, for supporting any suitable thermal energy responsive material 34, e.g. honeycombed metal or ceramic-type material, ceramic chips, cellulosic material, or particulate material such as pebbles, through which gas can circulate and which can be heated and cooled during a thermal energy exchange between the gas and material. A single perforated plate 33 is normally used to support particulate matter when the rotary member 7 is designed to rotate in a horizontal plane. The use of similar particulate matter would require the use of a second perforated plate to confine the particulate matter, in cases where, for example, the rotary member 7 is designed to rotate in a vertical plane, or in a plane which is angularly disposed to the horizontal. It can be appreciated that the material 34 can be any appropriate catalyst, regenerative or concentrating solid, or any other composition of matter necessary to carry on any of the aforementioned processes.

The rotary member 7 is mounted on a plurality of sets of casters 35,36 which are equally arcuately spaced around the annular bottom 19 of the rotary member 7. The casters 35,36 are supported on, and movable along, a platform 37 which can be apart from the device 5, or secured to the stationary member 6, depending on the size of the device 5, especially the revolving member or torus 7. In smaller devices, the rotary member 7 can be journalled in the stationary member 6 for rotation on, for example, ballbearings. Ballbearings can be used between the platform 37 and rotary member 7 in place of the casters, or the rotary member 7 can be floated on any suitable fluidized bed. Thus, any appropriate rotary mounting of the rotary member 7 can be provided, depending on the particular size and weight of the device 5, or the mounting desired.

Any suitable ring seal arrangements 38,39 and 40 can be provided in the annular space between the stationary and rotary members 6 and 7, adjacent the top and bottom walls 18,19 of the rotary member 7 and the horizontal divider 10 of the stationary member 6, respectively. A plurality of any appropriate flap-type seals, e.g. seals 41,42 are vertically secured longitudinally of the stationary member 6 between the ring seals 38–40 in radial alignment with the longitudinal divider 9 of the stationary member 6 for compressive sealing engagement with the adjacent inner peripheral wall 20 of the rotary member 7. The ring seals 38–40 and flap seals 41,42 coact to divide the annular space between the stationary and rotating members 6,7 into four segments which are generally in radial alignment and communication with the four compartments of the stationary member 6 and which, like the four compartments, are sealed from each other. It can be appreciated that diagonally opposite pairs of compartments can be placed in communication by spiraling dividers and flap seals, if desired. In any case, the compartments 11–14 of the stationary member 6 and any communicating sections of the rotary member 7 are literally divided into two sides or a pair of hot and cold air chambers 43,44, the sections of the rotary member 7 in the two chambers 43,44 constantly changing as the rotary member 7 revolves around the stationary member 6.

A single flap seal can be used in place of the spaced apart, double flap seals 41–42, so long as it is designed to span and cover an opening 32 in the inner peripheral wall 20 of the rotary member 7. Otherwise, gas will bypass the seals and circulate around the stationary member 6 to disrupt the thermal energy transferring process being carried on in the hot and cold air chambers 43,44. It can be appreciated that the combination of flap seals and sealing rings, provides a highly improved and effective seal of the hot and cold air chambers 43,44 from each other and the ambient atmosphere, and prevents undesireable leakage of gas between the two chambers to disrupt the thermal energy transferring process.

The driving mechanism 8 comprises any suitable driving wheel 45 which can be a rubber wheel or toothed gear that is designed for meshing engagement with a matingly toothed rack 46 which is secured circumferentially around the outer peripheral wall 21 of the rotary member 7. The drive wheel 45 is rotated by any suitable means, e.g. an electric motor 47 and connected gear box 48.

In operation, for example, hot exhaust gas from a heat treatment process is circulated through the inlet port 16 into the first compartment 11 of the hot air compartments 11,12 of the stationary member 6, from which the hot gas passes into the particular sections of the rotary member 7 which are, at that time, in communication with the first compartment 11 through radially aligned openings 15,32. The hot gas passes upwardly through the pebbles or honeycombed ceramic-type material 34, etc., whichever is used, to heat the material, after which the then cooled hot gas passes into the second compartment 12 of the hot air compartments 11,12 and out through the outlet port 17 to be reused elsewhere or discharged into the ambient atmosphere. Simultaneously, cool combustion air is circulated through the inlet port 16 of the first compartment 13 of the cold air compartments 13,14, of the stationary member 6, from which the cool combustion air circulates into the remaining sections which are in communication with the first cold air compartment 13. The cool combustion air passes downwardly through the ceramic-type material 34, assumed to be previously heated by the hot exhaust gas, whereby the material 34 is cooled and the cool combustion air is preheated, after which the preheated combustion air circulates back into the second compartment 14 of the cold air compartments 13,14 and subsequently exits through the outlet port 17 to a burner or burners used in the heat treatment process in which the hot exhaust gas is removed for preheating the cool combustion air. The cooled and heated ceramic materials are then rotated into the opposing hot and cold air chambers 43,44 and the process repeated.

It should be obvious that the various sections 23–30 of the rotary member 7 become part of either the hot or cold air chambers 43,44, as they pass alternately into the areas or sides that are vertically divided by the flap seals 41,42.

As previously indicated, the rotary member 7, is divided into a plurality of pie-shaped sections 23–30. It can be appreciated that the thermal energy exchanging process would be disrupted when the openings were covered by the opposing flap seals 41,42, if the rotary member 7 was divided into two sections with singular openings. Actually, there is a disruption in the flow of gas and consequent drop or fluctuation in the gas pressure, everytime one of the flap seals 41,42 covers an opening 32 in the sections 23–30. If the rotary member 7 is divided into four segments, then there will be less disruption of the flow of gas and a smaller pressure drop. From a practical standpoint, it appears that there should be provided a minimum number of four sections in the rotary member 7 to keep the thermal energy transfer process from becoming completely disrupted for short periods of time. Thus, it should be understood that the number of sections of the rotary member 7 is correlated, and dependent on, the gas flow or gas pressure fluctuation. Suppose, for example, a certain gas pressure drop or fluctuation is desired, and that in order to achieve such desired results it will be necessary to provide eight pie-shaped sections, as shown in FIG. 2. Then it is only a matter of designing the openings to accommodate the flow of gas desired. The size of the openings in the compartments 11–14 and sections 23–30 are dependent on a particular gas flow. The particular shape of the openings is not critical, so long as the openings are properly sized to achieve the desired flow of gas through the device 5.

Figure 3:
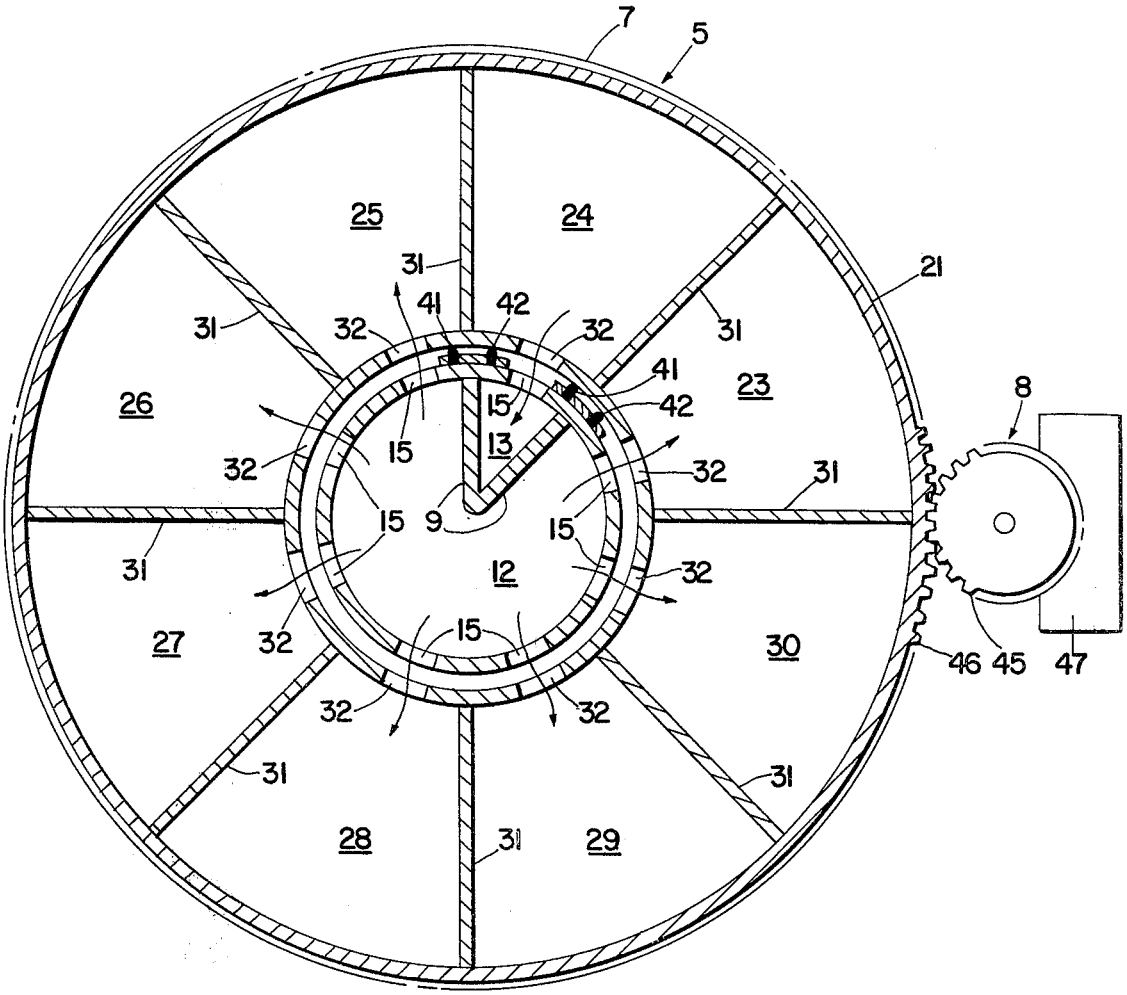
FIG. 3 is a section similar to that of FIG. 2, but of another embodiment.

The embodiment of FIG. 3 is essentially the same as that of FIG. 2, except that the longitudinal divider 9 is V-shaped to provide a pair of longitudinally extending and aligned pie-shaped compartments which are separated and, at any time, in communication with only one of the sections of the rotary member 7. Such a design is beneficial when a disportionate share of sections are needed to accomplish different tasks in a particular process. For example, in the cleaning of a specific gas, it may be necessary to use seven sections in the cleaning operation and only one section in the rehabilitation of the gas cleaning material carried by the sections of the rotary member 7. It should be understood that the stationary and rotary members can be divided, accordingly, into any number of compartments and sections, depending on the requirements of the process involved.

Thus, there has been described a highly improved thermal energy exchanging device, wherein any suitable particulate or solid matter can be used as a thermal energy transferring medium. Furthermore, it is not necessary to provide the complex sealing arrangement between the energy transferring medium. Furthermore, it is not necessary to provide the complex sealing arrangement between the energy transferring medium and other components of the device as is the case with known devices. The device, because of its unique design, can be used for any number of processes, a few of which have been mentioned above.

The generally solid material located in each of the sections between the longitudinally spaced openings in the inner cylindrical wall of the rotary member, divides the sections transversely into two parts which are continually moving into and out of communication with the hot and cold compartments of the stationary member, as the rotary member revolves. It can be appreciated that this division of the sections can be accomplished by radially oriented dividers, which are continuous throughout the length of the sections, in combination with pie-shaped perforated plates between such dividers or by a single, annular perforated plate which disrupts the continuity of the dividers and separates each divider into a pair of dividers which abut the plate in radial alignment.

What is claimed is:

1. In combination:

(a) a stationary, hollow, elongated cylindrical member which has a vertically disposed outer cylindrical wall and which is sealingly divided longitudinally and transversely into at least four separated compartments, a first pair of spaced, longitudinally extending compartments relative to the longitudinal axis of the stationary member, being designed to communicate with each other, and a second pair of spaced, longitudinally extending compartments designed to be in communication with each other, the compartments each having at least one opening in the outer cylindrical wall of the member;

(b) a hollow, closed torus-shaped member mounted for rotation in a horizontal plane about the stationary member, the rotary member having a vertically disposed inner cylindrical wall which is radially spaced exteriorally of the outer cylindrical wall of the stationary member, relative to the longitudinal axis of the stationary member, and an annular enclosure which extends from the inner cylindrical wall and which is sealingly divided longitudinally into a plurality of vertically disposed generally pie-shaped sections, each of which sections has at least one pair of vertically spaced openings in the inner cylindrical wall, between which openings is located material that divides each of the sections transversely into two parts and through which fluid passes between the two parts; and (c) sealing means coacting between the rotary and stationary member to divide the space between the inner and outer cylindrical walls into at least four segments which are in communication with the four compartments, so that during rotation of the rotary member certain sections of the rotary member will be in fluid circulating communication with the first pair of compartments while other sections will be in fluid circulating communication with the second pair of compartments.

2. The device of claim 1, wherein the first and second pairs of compartments are in longitudinal alignment and the segments are generally in radial alignment with the compartments.

3. The combination of claim 2, wherein the sealing means includes, at least three ring seals that are spaced longitudinally of the stationary member and extend circumferentially therearound to produce a pair of annular spaces in side-by-side circumferential relation between the two members, and a plurality of flap seals secured longitudinally of the stationary member and coacting with the ring seals to divide the space between the members into four segments which are generally in radial alignment with the four compartments of the stationary member.

4. The combination of claim 3, wherein the sealing means includes means for positioning the three ring seals adjacent, (i) opposing annular endwalls of the rotary member spaced longitudinally of the stationary member, and (ii) adjacent a divider which transversely divides the stationary member.

5. The combination of claim 4, which includes means coacting with the rotary member for supporting fluid impervious material in the sections in spaced relation from opposing annular endwalls of the rotary member.

6. The combination of claim 5, wherein the material supporting means includes a horizontal perforated plate in each of the sections.

7. The combination of claim 6, which includes:

(d) means for rotating the rotary member; and (f) means supporting the rotary member for rotation about the stationary member in a horizontal plane which is normal to the longitudinal axis of the stationary member.

8. The combination of claim 7, which includes means for simultaneously circulating separate fluids through the first and second pairs of compartments and the sections in communication therewith.

9. In combination:

(a) a stationary, hollow, elongated cylindrical member which has a vertically disposed outer cylindrical wall and which is sealingly divided longitudinally and transversely into at least four compartments, a first pair of generally longitudinally aligned compartments, relative to the longitudinal axis of the stationary member, being designed to communicate with each other, and a second pair of generally longitudinally aligned compartments designed to be in communication with each other, the compartments each having at least one opening in the outer cylindrical wall of the member, the first and second pairs of compartments each having an inlet port and an outlet port through which fluid enters and exits the compartments;

(b) a hollow, closed torus-shaped member mounted for rotation about the stationary member, the rotary member having, a vertically disposed outer cylindrical wall concentrically spaced exteriorly of an inner cylindrical wall which is concentrically spaced, exteriorly of the outer cylindrical wall of the stationary member, the inner and outer cylindrical walls of the rotary member defining therebetween an annular enclosure which is sealingly divided longitudinally into a plurality of vertically extending generally pie-shaped sections, each of which sections is transversely divided into two parts by material through which fluid passes between the two parts of each section, the sections each having a pair of vertically spaced openings in the inner cylindrical wall on opposite sides of the material, the openings in the inner cylindrical wall corresponding to the openings in the outer cylindrical wall of the stationary member;

(c) means carried by the rotary member for supporting the material in the sections generally midway between opposing, longitudinally spaced annular endwalls of the rotary member;

(d) means mounting the rotary member for rotation in a horizontal plane which is normal to the longitudinal axis of the stationary member;

(e) at least three annular ring seals coacting between the rotary and stationary members to vertically divide the annular space between the inner and outer cylindrical walls thereof into a pair of annular spaces which are spaced longitudinally of the stationary member in circumferential side-by-side relation;

(f) a plurality of flap seals secured longitudinally of the stationary member between the ring seals to sealingly engage the rotary member, the flap and ring seals dividing the space between the inner and outer cylindrical walls of the rotary and stationary members into four segments which are sealed from each other and generally in radial alignment with the four compartments of the stationary members;

(g) means for rotating the rotary member around the stationary member; and (h) means for simultaneously circulating fluid through the first and second pairs of compartments and the sections in communication therewith for contact with the material in the sections.

10. The combination of claim 9, wherein the material supporting means includes at least one perforated plate through which fluid can pass.

11. The combination of claim 10, wherein the material carried by the rotary member is thermal energy responsive material.

12. The combination of claim 11, wherein the thermal energy responsive material includes honeycombed ceramic-type material.

13. The combination of claim 11, wherein the thermal energy responsive material includes particulate material.

14. The combination of claims 1 or 9, wherein the material carried by the rotary member is chemically reactive and includes a reactant which changes chemically upon contact with a fluid circulating through some of the sections and returns to its original chemistry upon contact with another fluid circulating through some of the other sections.

15. The combination of claims 1 or 9, wherein the material carried by the rotary member includes a catalyst deposited by a fluid passing therethrough in some of the sections.

16. The combination of claims 1 or 9, wherein the material carried by the rotary member is a liquid absorption and desorption material, depending on the fluid circulated therethrough.

17. The combination of claims 1 or 9, wherein the stationary member includes in the outer cylindrical wall thereof, vertically spaced and aligned openings which correspond, in number and location, to the openings in the inner cylindrical wall of the rotary member, the openings in the rotary and stationary members being designed to be in simultaneous radial alignment, relative to the longitudinal axis of the stationary member.

18. The combination of claims 9 or 12, wherein the means (d) for mounting the rotary member includes means exteriorly of the outer cylindrical wall of the stationary member for supporting the rotary member as it rotates.

* * * * *